US009805641B2

(12) United States Patent
Koyama

(10) Patent No.: US 9,805,641 B2
(45) Date of Patent: Oct. 31, 2017

(54) DISPLAY DEVICE AND ELECTRONIC DEVICE INCLUDING THE SAME

(75) Inventor: Jun Koyama, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1416 days.

(21) Appl. No.: 12/873,703

(22) Filed: Sep. 1, 2010

(65) Prior Publication Data

US 2011/0057865 A1 Mar. 10, 2011

(30) Foreign Application Priority Data

Sep. 4, 2009 (JP) ..... 2009-205132

(51) Int. Cl.
*G09G 3/32* (2016.01)
*G09G 3/20* (2006.01)

(52) U.S. Cl.
CPC ..... *G09G 3/32* (2013.01); *G09G 3/2074* (2013.01)

(58) Field of Classification Search
CPC ..... G09G 3/3233; G09G 3/2074
USPC ..... 345/80, 88
See application file for complete search history.

(56) References Cited

U.S. PATENT DOCUMENTS 5,731,856 A 3/1998 Kim et al.
5,744,864 A 4/1998 Cillessen et al.
6,225,967 B1 5/2001 Hebiguchi
6,294,219 B1 9/2001 Tsai et al.
6,294,274 B1 9/2001 Kawazoe et al.
6,563,174 B2 5/2003 Kawasaki et al.
6,610,374 B2 8/2003 Tsai et al.
6,727,522 B1 4/2004 Kawasaki et al.
7,049,190 B2 5/2006 Takeda et al.
7,061,014 B2 6/2006 Hosono et al.
(Continued)

FOREIGN PATENT DOCUMENTS

EP 1 737 044 A1 12/2006
EP 1770788 A 4/2007
(Continued)

OTHER PUBLICATIONS

Asakuma, N et al., "Crystallization and Reduction of Sol-Gel-Derived Zinc Oxide Films by Irradiation With Ultraviolet Lamp," Journal of Sol-Gel Science and Technology, 2003, vol. 26, pp. 181-184.

(Continued)

*Primary Examiner* — Ariel Balaoing
(74) *Attorney, Agent, or Firm* — Fish & Richardson P.C.

(57) ABSTRACT

The display device includes a first pixel, a second pixel, and a third pixel each including a first transistor, a second transistor, and a light-emitting element. In each of the first to third pixels, a first terminal of the first transistor is electrically connected to a signal line, a second terminal of the first transistor is electrically connected to a gate of the second transistor, a first terminal of the second transistor is electrically connected to a power supply line and a second terminal of the first transistor is electrically connected to the light-emitting element. A gate of the first transistor in the first pixel is electrically connected to a first scan line. A gate of the first transistor in the second pixel is electrically connected to a second scan line. A gate of the first transistor in the third pixel is electrically connected to a third scan line.

8 Claims, 10 Drawing Sheets

(56) References Cited

U.S. PATENT DOCUMENTS

| | | | |
|---|---|---|---|
| 7,064,346 | B2 | 6/2006 | Kawasaki et al. |
| 7,105,868 | B2 | 9/2006 | Nause et al. |
| 7,211,825 | B2 | 5/2007 | Shih et al |
| 7,282,782 | B2 | 10/2007 | Hoffman et al. |
| 7,297,977 | B2 | 11/2007 | Hoffman et al. |
| 7,323,356 | B2 | 1/2008 | Hosono et al. |
| 7,385,224 | B2 | 6/2008 | Ishii et al. |
| 7,402,506 | B2 | 7/2008 | Levy et al. |
| 7,411,209 | B2 | 8/2008 | Endo et al. |
| 7,453,065 | B2 | 11/2008 | Saito et al. |
| 7,453,087 | B2 | 11/2008 | Iwasaki |
| 7,462,862 | B2 | 12/2008 | Hoffman et al. |
| 7,468,304 | B2 | 12/2008 | Kaji et al. |
| 7,473,928 | B1 | 1/2009 | Yamazaki et al. |
| 7,501,293 | B2 | 3/2009 | Ito et al. |
| 7,674,650 | B2 | 3/2010 | Akimoto et al. |
| 7,732,819 | B2 | 6/2010 | Akimoto et al. |
| 7,910,490 | B2 | 3/2011 | Akimoto et al. |
| 7,932,521 | B2 | 4/2011 | Akimoto et al. |
| 7,994,810 | B2 | 8/2011 | Hayashi |
| 8,212,248 | B2 | 7/2012 | Itagaki et al. |
| 8,274,077 | B2 | 9/2012 | Akimoto et al. |
| 8,324,916 | B2 | 12/2012 | Hayashi |
| 8,466,463 | B2 | 6/2013 | Akimoto et al. |
| 8,629,069 | B2 | 1/2014 | Akimoto et al. |
| 8,669,550 | B2 | 3/2014 | Akimoto et al. |
| 8,785,240 | B2 | 7/2014 | Watanabe |
| 8,790,959 | B2 | 7/2014 | Akimoto et al. |
| 8,796,069 | B2 | 8/2014 | Akimoto et al. |
| 9,099,562 | B2 | 8/2015 | Akimoto et al. |
| 2001/0046027 | A1 | 11/2001 | Tai et al. |
| 2002/0056838 | A1 | 5/2002 | Ogawa |
| 2002/0132454 | A1 | 9/2002 | Ohtsu et al. |
| 2003/0169220 | A1 | 9/2003 | Tsuchiya |
| 2003/0189401 | A1 | 10/2003 | Kido et al. |
| 2003/0218222 | A1 | 11/2003 | Wager, III et al. |
| 2004/0038446 | A1 | 2/2004 | Takeda et al. |
| 2004/0127038 | A1 | 7/2004 | Carcia et al. |
| 2005/0017302 | A1 | 1/2005 | Hoffman |
| 2005/0199959 | A1 | 9/2005 | Chiang et al. |
| 2006/0035452 | A1 | 2/2006 | Carcia et al. |
| 2006/0038501 | A1* | 2/2006 | Koyama et al. ..... 315/169.3 |
| 2006/0043377 | A1 | 3/2006 | Hoffman et al. |
| 2006/0091793 | A1 | 5/2006 | Baude et al. |
| 2006/0108529 | A1 | 5/2006 | Saito et al. |
| 2006/0108636 | A1 | 5/2006 | Sano et al. |
| 2006/0110867 | A1 | 5/2006 | Yabuta et al. |
| 2006/0113536 | A1 | 6/2006 | Kumomi et al. |
| 2006/0113539 | A1 | 6/2006 | Sano et al. |
| 2006/0113549 | A1 | 6/2006 | Den et al. |
| 2006/0113565 | A1 | 6/2006 | Abe et al. |
| 2006/0169973 | A1 | 8/2006 | Isa et al. |
| 2006/0170111 | A1 | 8/2006 | Isa et al. |
| 2006/0197092 | A1 | 9/2006 | Hoffman et al. |
| 2006/0208977 | A1 | 9/2006 | Kimura |
| 2006/0228974 | A1 | 10/2006 | Thelss et al. |
| 2006/0231882 | A1 | 10/2006 | Kim et al. |
| 2006/0238135 | A1 | 10/2006 | Kimura |
| 2006/0244107 | A1 | 11/2006 | Sugihara et al. |
| 2006/0284171 | A1 | 12/2006 | Levy et al. |
| 2006/0284172 | A1 | 12/2006 | Ishii |
| 2006/0292777 | A1 | 12/2006 | Dunbar |
| 2007/0024187 | A1 | 2/2007 | Shin et al. |
| 2007/0046191 | A1 | 3/2007 | Saito |
| 2007/0052025 | A1 | 3/2007 | Yabuta |
| 2007/0054507 | A1 | 3/2007 | Kaji et al. |
| 2007/0075627 | A1* | 4/2007 | Kimura et al. ..... 313/503 |
| 2007/0090365 | A1 | 4/2007 | Hayashi et al. |
| 2007/0091044 | A1* | 4/2007 | Park et al. ..... 345/88 |
| 2007/0108446 | A1 | 5/2007 | Akimoto |
| 2007/0152217 | A1 | 7/2007 | Lai et al. |
| 2007/0172591 | A1 | 7/2007 | Seo et al. |
| 2007/0187678 | A1 | 8/2007 | Hirao et al. |
| 2007/0187760 | A1 | 8/2007 | Furuta et al. |
| 2007/0194379 | A1 | 8/2007 | Hosono et al. |
| 2007/0252928 | A1 | 11/2007 | Ito et al. |
| 2007/0272922 | A1 | 11/2007 | Kim et al. |
| 2007/0287296 | A1 | 12/2007 | Chang |
| 2008/0006877 | A1 | 1/2008 | Mardilovich et al. |
| 2008/0038882 | A1 | 2/2008 | Takechi et al. |
| 2008/0038929 | A1 | 2/2008 | Chang |
| 2008/0050595 | A1 | 2/2008 | Nakagawara et al. |
| 2008/0073653 | A1 | 3/2008 | Iwasaki |
| 2008/0083950 | A1 | 4/2008 | Pan et al. |
| 2008/0106191 | A1 | 5/2008 | Kawase |
| 2008/0128689 | A1 | 6/2008 | Lee et al. |
| 2008/0129195 | A1 | 6/2008 | Ishizaki et al. |
| 2008/0166834 | A1 | 7/2008 | Kim et al. |
| 2008/0182358 | A1 | 7/2008 | Cowdery-Corvan et al. |
| 2008/0224133 | A1 | 9/2008 | Park et al. |
| 2008/0254569 | A1 | 10/2008 | Hoffman et al. |
| 2008/0258139 | A1 | 10/2008 | Ito et al. |
| 2008/0258140 | A1 | 10/2008 | Lee et al. |
| 2008/0258141 | A1 | 10/2008 | Park et al. |
| 2008/0258143 | A1 | 10/2008 | Kim et al. |
| 2008/0296568 | A1 | 12/2008 | Ryu et al. |
| 2008/0308805 | A1 | 12/2008 | Akimoto et al. |
| 2009/0068773 | A1 | 3/2009 | Lai et al. |
| 2009/0073325 | A1 | 3/2009 | Kuwabara et al. |
| 2009/0114910 | A1 | 5/2009 | Chang |
| 2009/0134399 | A1 | 5/2009 | Sakakura et al. |
| 2009/0152506 | A1 | 6/2009 | Umeda et al. |
| 2009/0152541 | A1 | 6/2009 | Maekawa et al. |
| 2009/0160741 | A1 | 6/2009 | Inoue |
| 2009/0278122 | A1 | 11/2009 | Hosono et al. |
| 2009/0280600 | A1 | 11/2009 | Hosono et al. |
| 2010/0065844 | A1 | 3/2010 | Tokunaga |
| 2010/0092800 | A1 | 4/2010 | Itagaki et al. |
| 2010/0109002 | A1 | 5/2010 | Itagaki et al. |
| 2010/0140599 | A1 | 6/2010 | Yano et al. |
| 2011/0104851 | A1 | 5/2011 | Akimoto et al. |
| 2011/0121290 | A1 | 5/2011 | Akimoto et al. |
| 2015/0340513 | A1 | 11/2015 | Akimoto et al. |

FOREIGN PATENT DOCUMENTS

| | | | |
|---|---|---|---|
| EP | 1995787 | A | 11/2008 |
| EP | 1998373 | A | 12/2008 |
| EP | 1998374 | A | 12/2008 |
| EP | 1998375 | A | 12/2008 |
| EP | 2006824 | A2 | 12/2008 |
| EP | 2 226 847 | A2 | 9/2010 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 10-010546 | A | 1/1998 |
| JP | 11-505377 | A | 5/1999 |
| JP | 2000-044236 | A | 2/2000 |
| JP | 2000-150900 | A | 5/2000 |
| JP | 2001-332734 | A | 11/2001 |
| JP | 2002-505531 | | 2/2002 |
| JP | 2002-076356 | A | 3/2002 |
| JP | 2002-289859 | A | 10/2002 |
| JP | 2003-086000 | A | 3/2003 |
| JP | 2003-086808 | A | 3/2003 |
| JP | 2003263128 | A | 9/2003 |
| JP | 2004-103957 | A | 4/2004 |
| JP | 2004-273614 | A | 9/2004 |
| JP | 2004-273732 | A | 9/2004 |
| JP | 2006251774 | A | 9/2006 |
| JP | 2007-096055 | A | 4/2007 |
| JP | 2007-123861 | A | 5/2007 |
| JP | 2007286150 | A | 11/2007 |
| JP | 2008-243929 | A | 10/2008 |
| JP | 2008-281988 | A | 11/2008 |
| JP | 2009-164393 | A | 7/2009 |
| WO | WO-99/45164 | | 9/1999 |

(56) References Cited

FOREIGN PATENT DOCUMENTS

| | | |
|---|---|---|
| WO | 2004/114391 A1 | 12/2004 |
| WO | WO-2008/126879 | 10/2008 |
| WO | WO-2009/087943 | 7/2009 |

OTHER PUBLICATIONS

Asaoka, Y et al., "29.1: Polarizer-Free Reflective LCD Combined With Ultra Low-Power Driving Technology," SID Digest '09 : SID International Symposium Digest of Technical Papers, 2009, pp. 395-398.
Chern, H et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.
Cho, D et al., "21.2: Al and Sn-Doped Zinc Indium Oxide Thin Film Transistors for AMOLED Back-Plane," SID Digest '09 : SID International Symposium Digest of Technical Papers, May 31, 2009, pp. 280-283.
Clark, S et al., "First Principles Methods Using CASTEP," Zeitschrift fur Kristallographie, 2005, vol. 220, pp. 567-570.
Coates, D et al., Optical Studies of the Amorphous Liquid—Cholesteric Liquid Crystal Transition: The "Blue Phase," Physics Letters, Sep. 10, 1973, vol. 45A, No. 2, pp. 115-116.
Costello, M et al., "Electron Microscopy of a Cholesteric Liquid Crystal and Its Blue Phase," Phys. Rev. A (Physical Review. A), May 1, 1984, vol. 29, No. 5, pp. 2957-2959.
Dembo, H et al., "RFCPUS on Glass and Plastic Substrates Fabricated by TFT Transfer Technology," IEDM 05: Technical Digest of International Electron Devices Meeting, Dec. 5, 2005, pp. 1067-1069.
Fortunato, E et al., "Wide-Bandgap High-Mobility ZnO Thin-Film Transistors Produced At Room Temperature," Appl. Phys. Lett. (Applied Physics Letters), Sep. 27, 2004, vol. 85, No. 13, pp. 2541-2543.
Fung, T et al., "2-D Numerical Simulation of High Performance Amorphous In—Ga—Zn—O TFTs for Flat Panel Displays," AM-FPD '08 Digest of Technical Papers, Jul. 2, 2008, pp. 251-252, The Japan Society of Applied Physics.
Godo, H et al., "P-9: Numerical Analysis on Temperature Dependence of Characteristics of Amorphous In—Ga—Zn—Oxide TFT," SID Digest '09 : SID International Symposium Digest of Technical Papers, May 31, 2009, pp. 1110-1112.
Godo, H et al., "Temperature Dependence of Characteristics and Electronic Structure for Amorphous In—Ga—Zn—Oxide TFT," AM-FPD '09 Digest of Technical Papers, Jul. 1, 2009, pp. 41-44.
Hayashi, R et al., "42.1: Invited Paper: Improved Amorphous In—Ga—Zn—O TFTs," SID Digest '08 : SID International Symposium Digest of Technical Papers, May 20, 2008, vol. 39, pp. 621-624.
Hirao, T et al., "Novel Top-Gate Zinc Oxide Thin-Film Transistors (ZnO TFTs) for AMLCDs," Journal of the SID , 2007, vol. 15, No. 1, pp. 17-22.
Hosono, H et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Hosono, H, "68.3: Invited Paper:Transparent Amorphous Oxide Semiconductors for High Performance TFT," SID Digest '07 : SID International Symposium Digest of Technical Papers, 2007, vol. 38, pp. 1830-1833.
Hsieh, H et al., "P-29: Modeling of Amorphous Oxide Semiconductor Thin Film Transistors and Subgap Density of States," SID Digest '08 : SID International Symposium Digest of Technical Papers, 2008, vol. 39, pp. 1277-1280.
Ikeda., T et al., "Full-Functional System Liquid Crystal Display Using CG-Silicon Technology," SID Digest '04 : SID International Symposium Digest of Technical Papers, 2004, vol. 35, pp. 860-863.
Janotti, A et al., "Native Point Defects in ZnO," Phys. Rev. B (Physical Review. B), 2007, vol. 76, No. 16, pp. 165202-1-165202-22.
Janotti, A et al., "Oxygen Vacancies in ZnO," Appl. Phys. Lett. (Applied Physics Letters), 2005, vol. 87, pp. 122102-1-122102-3.
Jeong, J et al., "3.1: Distinguished Paper: 12.1-Inch WXGA AMOLED Display Driven by Indium-Gallium-Zinc Oxide TFTs Array," SID Digest '08 : SID International Symposium Digest of Technical Papers, May 20, 2008, vol. 39, No. 1, pp. 1-4.
Jin, D et al., "65.2: Distinguished Paper:World-Largest (6.5") Flexible Full Color Top Emission AMOLED Display on Plastic Film and Its Bending Properties," SID Digest '09 : SID International Symposium Digest of Technical Papers, May 31, 2009, pp. 983-985.
Kanno, H et al., "White Stacked Electrophosphorecent Organic Light-Emitting Devices Employing MOO3 As a Charge-Generation Layer," Adv. Mater. (Advanced Materials), 2006, vol. 18, No. 3, pp. 339-342.
Kikuchi, H et al., "39.1: Invited Paper: Optically Isotropic Nano-Structured Liquid Crystal Composites for Display Applications," SID Digest '09 : SID International Symposium Digest of Technical Papers, May 31, 2009, pp. 578-581.
Kikuchi, H et al., "62.2: Invited Paper: Fast Electro-Optical Switching in Polymer-Stabilized Liquid Crystalline Blue Phases for Display Application," SID Digest '07 : SID International Symposium Digest of Technical Papers, 2007, vol. 38, pp. 1737-1740.
Kikuchi, H et al., "Polymer-Stabilized Liquid Crystal Blue Phases," Nature Materials, Sep. 1, 2002, vol. 1, pp. 64-68.
Kim, S et al., "High-Performance oxide thin film transistors passivated by various gas plasmas," The Electrochemical Society, 214th ECS Meeting, 2008, No. 2317, 1 page.
Kimizuka, N et al., "Spinel,YBFe2O4, and YB2Fe3O7 Types of Structures for Compounds in the In2O3 and SC2O3—A2O3—BO Systems [A; Fe, Ga, or Al; B: Mg, Mn, Fe, Ni, Cu,or Zn] At Temperatures Over 1000° C.," Journal of Solid State Chemistry, 1985, vol. 60, pp. 382-384.
Kimizuka, N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3—ZnGa2O4—ZnO System," Journal of Solid State Chemistry, Apr. 1, 1995, vol. 116, No. 1, pp. 170-178.
Kitzerow, H et al., "Observation of Blue Phases in Chiral Networks," Liquid Crystals, 1993, vol. 14, No. 3, pp. 911-916.
Kurokawa, Y et al., "UHF RFCPUS on Flexible and Glass Substrates for Secure RFID Systems," Journal of Solid-State Circuits , 2008, vol. 43, No. 1, pp. 292-299.
Lany, S et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Lee, H et al., "Current Status of, Challenges to, and Perspective View of AM-OLED," IDW '06 : Proceedings of the 13th International Display Workshops, Dec. 7, 2006, pp. 663-666.
Lee, J et al., "World's Largest (15-Inch) XGA AMLCD Panel Using IGZO Oxide TFT," SID Digest '08 : SID International Symposium Digest of Technical Papers, May 20, 2008, vol. 39, pp. 625-628.
Lee, M et al., "15.4: Excellent Performance of Indium-Oxide-Based Thin-Film Transistors by DC Sputtering," SID Digest '09 : SID International Symposium Digest of Technical Papers, May 31, 2009, pp. 191-193.
Li, C et al., "Modulated Structures of Homologous Compounds InMO3(ZnO)m (M=In,Ga; m=Integer) Described by Four-Dimensional Superspace Group," Journal of Solid State Chemistry, 1998, vol. 139, pp. 347-355.
Masuda, S et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Meiboom, S et al., "Theory of the Blue Phase of Cholesteric Liquid Crystals," Phys. Rev. Lett. (Physical Review Letters), May 4, 1981, vol. 46, No. 18, pp. 1216-1219.
Miyasaka, M, "Suftla Flexible Microelectronics on Their Way to Business," SID Digest '07 : SID International Symposium Digest of Technical Papers, 2007, vol. 38, pp. 1673-1676.

(56) References Cited

OTHER PUBLICATIONS

Mo, Y et al., "Amorphous Oxide TFT Backplanes for Large Size AMOLED Displays," IDW '08 : Proceedings of the 6th International Display Workshops, Dec. 3, 2008, pp. 581-584.
Nakamura, "Synthesis of Homologous Compound with New Long-Period Structure," NIRIM Newsletter, Mar. 1995, vol. 150, pp. 1-4 with English translation.
Nakamura, M et al., "The phase relations in In2O3—Ga2ZnO4—ZnO system at 1350° C.," Journal of Solid State Chemistry, Aug. 1, 1991, vol. 93, No. 2, pp. 298-315.
Nomura, K et al., "Thin-Film Transistor Fabricated in Single-Crystalline Transparent Oxide Semiconductor," Science, May 23, 2003, vol. 300, No. 5623, pp. 1269-1272.
Nomura, K et al., "Amorphous Oxide Semiconductors for High-Performance Flexible Thin-Film Transistors," Jpn. J. Appl. Phys. (Japanese Journal of Applied Physics) , 2006, vol. 45, No. 5B, pp. 4303-4308.
Nomura, K et al., "Carrier transport in transparent oxide semiconductor with intrinsic structural randomness probed using single-crystalline InGaO3(ZnO)5 films," Appl. Phys. Lett. (Applied Physics Letters) , Sep. 13, 2004, vol. 85, No. 11, pp. 1993-1995.
Nowatari, H et al., "60.2: Intermediate Connector With Suppressed Voltage Loss for White Tandem OLEDs," SID Digest '09 : SID International Symposium Digest of Technical Papers, May 31, 2009, vol. 40, pp. 899-902.
Oba, F et al., "Defect energetics in ZnO: A hybrid Hartree-Fock density functional study," Phys. Rev. B (Physical Review. B), 2008, vol. 77, pp. 245202-1-245202-6.
Oh, M et al., "Improving the Gate Stability of ZnO Thin-Film Transistors With Aluminum Oxide Dielectric Layers," J. Electrochem. Soc. (Journal of the Electrochemical Society), 2008, vol. 155, No. 12, pp. H1009-H1014.
Ohara, H et al., "21.3: 4.0 In. QVGA AMOLED Display Using In—Ga—Zn—Oxide TFTs With a Novel Passivation Layer," SID Digest '09 : SID International Symposium Digest of Technical Papers, May 31, 2009, pp. 284-287.
Ohara, H et al., "Amorphous In—Ga—Zn—Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Orita, M et al., "Amorphous transparent conductive oxide InGaO3(ZnO)m (m<4):a Zn4s conductor," Philosophical Magazine, 2001, vol. 81, No. 5, pp. 501-515.
Orita, M et al., "Mechanism of Electrical Conductivity of Transparent InGaZnO4," Phys. Rev. B (Physical Review. B), Jan. 15, 2000, vol. 61, No. 3, pp. 1811-1816.
Osada, T et al., "15.2: Development of Driver-Integrated Panel using Amorphous In—Ga—Zn—Oxide TFT," SID Digest '09 : SID International Symposium Digest of Technical Papers, May 31, 2009, pp. 184-187.
Osada, T et al., "Development of Driver-Integrated Panel Using Amorphous In—Ga—Zn—Oxide TFT," AM-FPD '09 Digest of Technical Papers, Jul. 1, 2009, pp. 33-36.
Park, J et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Park, J et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Park, J et al., "Electronic Transport Properties of Amorphous Indium-Gallium-Zinc Oxide Semiconductor Upon Exposure to Water," Appl. Phys. Lett. (Applied Physics Letters), 2008, vol. 92, pp. 072104-1-072104-3.
Park, J et al., "High performance amorphous oxide thin film transistors with self-aligned top-gate structure," IEDM 09: Technical Digest of International Electron Devices Meeting, Dec. 7, 2009, pp. 191-194.
Park, Sang-Hee et al., "42.3: Transparent ZnO Thin Film Transistor for the Application of High Aperture Ratio Bottom Emission AM-OLED Display," SID Digest '08 : SID International Symposium Digest of Technical Papers, May 20, 2008, vol. 39, pp. 629-632.
Park, J et al., "Amorphous Indium-Gallium-Zinc Oxide TFTs and Their Application for Large Size AMOLED," AM-FPD '08 Digest of Technical Papers, Jul. 2, 2008, pp. 275-278.
Park, S et al., "Challenge to Future Displays: Transparent AM-OLED Driven by Peald Grown ZnO TFT," IMID '07 Digest, 2007, pp. 1249-1252.
Prins, M et al., "A Ferroelectric Transparent Thin-Film Transistor," Appl. Phys. Lett. (Applied Physics Letters), Jun. 17, 1996, vol. 68, No. 25, pp. 3650-3652.
Sakata, J et al., "Development of 4.0-In. AMOLED Display With Driver Circuit Using Amorphous In—Ga—Zn—Oxide TFTs," IDW '09 : Proceedings of the 16th International Display Workshops, 2009, pp. 689-692.
Son, K et al., "42.4L: Late-News Paper: 4 Inch QVGA AMOLED Driven by the Threshold Voltage Controlled Amorphous GIZO (Ga2O3—In2O3—ZnO) TFT," SID Digest '08 : SID International Symposium Digest of Technical Papers, May 20, 2008, vol. 39, pp. 633-636.
Takahashi, M et al., "Theoretical Analysis of IGZO Transparent Amorphous Oxide Semiconductor," IDW '08 : Proceedings of the 15th International Display Workshops, Dec. 3, 2008, pp. 1637-1640.
Tsuda, K et al., "Ultra Low Power Consumption Technologies for Mobile TFT-LCDs," IDW '02 : Proceedings of the 9th International Display Workshops, Dec. 4, 2002, pp. 295-298.
Ueno, K et al., "Field-Effect Transistor on SrTiO3 with Sputtered Al2O3 Gate Insulator," Appl. Phys. Lett. (Applied Physics Letters), Sep. 1, 2003, vol. 83, No. 9, pp. 1755-1757.
Van De Walle, C, "Hydrogen as a Cause of Doping in Zinc Oxide," Phys. Rev. Lett. (Physical Review Letters), Jul. 31, 2000, vol. 85, No. 5, pp. 1012-1015.

* cited by examiner

DISPLAY DEVICE AND ELECTRONIC DEVICE INCLUDING THE SAME

BACKGROUND OF THE INVENTION

1. Field of the Invention

The present invention relates to a display device and an electronic device including the display device.

2. Description of the Related Art

Display devices are used for a variety of electric products such as mobile phones and television receivers. A manufacturing process, a driving method, and the like of display devices are researched and developed in order to enlarge the screen and to obtain high definition.

Display devices in which the number of pixels is increased to enhance the resolution are actively developed. Although the resolution of the display device can be enhanced by increase in the number of pixels, the number of signal lines also increases with the increase in the number of pixels. As measures against the increase in the number of source drivers needed, that is, the increase in the number of signal lines, Patent Document 1 discloses a structure in which pixels each corresponding to a combination of color elements (e.g., R (red), G (green), and B (blue)) forming one image are arranged along signal lines and a signal line is shared with the pixels each corresponding to a combination of the color elements forming one image, so that the number of signal lines is reduced.

Note that a pixel includes a color element forming one image, a light-emitting element, and an element that drives the light-emitting element (e.g., a circuit including a transistor). Furthermore, a picture element includes pixels composed of a group of color elements for displaying one minimum image. Therefore, in a color display device including color elements of R (red), G (green), and B (blue), a picture element is composed of three pixels including a color element of R, a color element of G, and a color element of B. Moreover, when a picture element includes a plurality of pixels, the pixels are called a first pixel, a second pixel, and the like in ascending order.

[Reference]

Patent Document 1: Japanese Published Patent Application No. H10-010546

SUMMARY OF THE INVENTION

Patent Document 1 discloses driving of a display device with an active-matrix structure in which signal lines and scan lines are arranged to cross each other vertically and horizontally as in a liquid crystal display device. A driver circuit for a light-emitting element or the like, however, needs power supply lines (also referred to as current supply lines) in addition to scan lines and signal lines.

Note that an electroluminescent (EL) element (e.g., an organic EL element, an inorganic EL element, or an EL element containing organic and inorganic materials) can be used as the light-emitting element.

An object to be solved by a structure disclosed in this specification is described with reference to FIGS. 10A to 10C. Note that a combination of R (red), G (green), and B (blue) is described as an example of a combination of color elements in pixels for color display.

FIG. 10A is a simplified diagram of a display device in which scan lines, signal lines, and power supply lines are provided in a display portion. FIG. 10A illustrates a scan line driver circuit 1001, a signal line driver circuit 1002, scan lines 1003, signal lines 1004, power supply lines 1005, and a display portion 1006. Note that the scan line driver circuit 1001 and the signal line driver circuit 1002 may be collectively referred to as a driver circuit 1007. The power supply lines 1005 are extended from a power supply circuit 1008 and supply a desired power supply voltage to each pixel. In the display portion 1006, a plurality of pixels 1009 are provided so as to be surrounded by the scan lines 1003, the signal lines 1004, and the power supply lines 1005. Note that described is the case of n scan lines 1003 ($G_1$ to $G_n$, n is a natural number), 3m signal lines 1004 ($S_{R1}$ to $S_{Rm}$, $S_{G1}$ to $S_{Gm}$, and $S_{B1}$ to $S_{Bm}$; m is a natural number), and 3m power supply lines 1005 ($V_{R1}$ to $V_{Rm}$, $V_{G1}$ to $V_{Gm}$, and $V_{B1}$ to $V_{Bm}$; m is a natural number). Therefore, (3m×n) pixels 1009 and (3m+3m+n) wirings are arranged in the display portion 1006.

FIG. 10B illustrates a picture element 1010 connected to a scan line $G_j$, signal lines $S_{Rk}$, $S_{Gk}$, and $S_{Bk}$, and power supply lines $V_{Rk}$, $V_{Gk}$, and $V_{Bk}$ (j and k are each a given natural number). The picture element 1010 includes a pixel 1009R corresponding to R, a pixel 1009G corresponding to and a pixel 1009B corresponding to B. Therefore, in one picture element, the signal lines $S_{Rk}$, $S_{Gk}$, and $S_{Bk}$ and the power supply lines $V_{Rk}$, $V_{Gk}$, and $V_{Bk}$ are placed in the direction perpendicular to the scan line 1003 and supply predetermined voltages and gray scale signals to each pixel. Moreover, the scan line is $G_j$ placed in the direction perpendicular to the signal line 1004 and the power supply line 1005. Since a driving voltage of a light-emitting element varies between color elements, the power supply lines $V_{Rk}$, $V_{Gk}$, and $V_{Bk}$ for supplying a power supply voltage to each pixel apply different power supply voltages depending on colors as illustrated in FIG. 10A.

FIG. 10C illustrates a basic circuit configuration for driving a light-emitting element included in each pixel. Transistors illustrated in FIG. 10C are manufactured using polycrystalline silicon formed in a low-temperature process for a semiconductor layer, like a transistor included in the driver circuit. FIG. 10C is a circuit diagram of a pixel in which an n-channel transistor is used as a selection transistor 1011 for selecting a pixel and a p-channel transistor is used as a driving transistor 1012 for supplying current to a light-emitting element 1013. In the configuration in FIG. 10C, a terminal of the driving transistor 1012 connected to the power supply line serves as a source terminal. Here, in the case where RGB is used as a combination of color elements in each pixel for color display and power supply lines for supplying a power supply voltage to each pixel are shared in common in order to reduce the number of power supply lines, driving voltages for each color element cannot be changed even though driving voltages are different between light-emitting elements of each color in each pixel. For that reason, a potential of a source of the driving transistor 1012 cannot be set in each color element, and a desired gray scale cannot be expressed only with a gate-source voltage (hereinafter also referred to as $V_{gs}$) of the driving transistor 1012 in some cases.

On the other hand, the power supply lines are often arranged in parallel to the signal lines as illustrated in FIGS. 10A to 10C, and the increase in the number of wirings is expected in the direction parallel to the signal lines. Therefore, the reduction in the number of wirings is necessary for a high definition display portion. Note that this tendency is pronounced as the number of color elements included in a picture element is increased; when the number of color elements is increased in order to improve the color expressivity, a problem that the distance between wirings is small becomes serious.

In view of the above, an object of one embodiment of the present invention is to provide a display device in which the number of signal lines and power supply lines is reduced and high definition display can be performed.

One embodiment of the present invention is a display device performing color display by using a combination of a first pixel, a second pixel, and a third pixel that are driven by a first scan line, a second scan line, a third scan line, a signal line, and a power supply line. The first pixel, the second pixel, and the third pixel each include a first transistor, a second transistor, and a light-emitting element. In each of the first pixel, the second pixel, and the third pixel, a first terminal of the first transistor is electrically connected to the signal line; a second terminal of the first transistor is electrically connected to a gate of the second transistor; a first terminal of the second transistor is electrically connected to the power supply line; and a second terminal of the second transistor is electrically connected to the light-emitting element. A gate of the first transistor in the first pixel is electrically connected to the first scan line. A gate of the first transistor in the second pixel is electrically connected to the second scan line. A gate of the first transistor in the third pixel is electrically connected to the third scan line.

In the display device according to one embodiment of the present invention, the first transistor and the second transistor may be n-channel transistors.

In the display device according to one embodiment of the present invention, a semiconductor layer in the first transistor and the second transistor may be formed using an oxide semiconductor.

In the display device according to one embodiment of the present invention, the first pixel, the second pixel, and the third pixel may be provided along the signal line or the power supply line.

In the display device according to one embodiment of the present invention, the first pixel, the second pixel, and the third pixel may include light-emitting elements corresponding to color elements of red, green, and blue, respectively.

In the display device according to one embodiment of the present invention, the light-emitting element may be an organic EL element.

Note that a display device corresponds to a device including a display element. The display device may include a plurality of pixels each having a display element. The display device may include a peripheral driver circuit for driving the plurality of pixels. The peripheral driver circuit for driving the plurality of pixels may be formed over the substrate where the plurality of pixels are formed. The display device may include a peripheral driver circuit provided over a substrate by wire bonding or bump bonding, that is, an IC chip connected by chip on glass (COG), TAB, or the like. Further, the display device may include a flexible printed circuit (FPC) to which an IC chip, a resistor, a capacitor, an inductor, a transistor, or the like is attached. The display device may include a printed wiring board (PWB) that is connected through a flexible printed circuit (FPC) or the like and provided with an IC chip, a resistor, a capacitor, an inductor, a transistor, or the like.

According to one embodiment of the present invention, a display device in which the number of signal lines and power supply lines is reduced and high definition display can be performed can be provided. Thus, although the number of scan lines is increased, the reduction in size and power consumption of the display device can be achieved.

DETAILED DESCRIPTION OF THE INVENTION

Figure 1A:
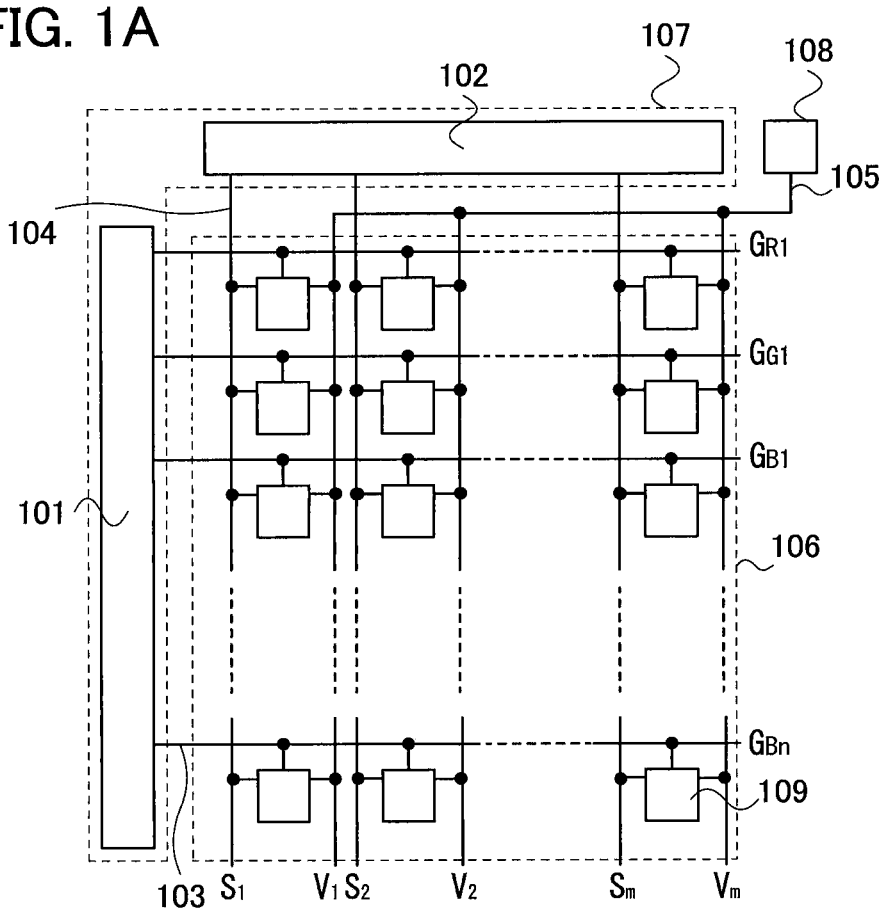
FIGS. 1A to 1C each illustrate a display device in Embodiment 1.

Embodiments of the present invention will be described below with reference to the accompanying drawings. The present invention can be implemented in various modes, and it is easily understood by those skilled in the art that modes and details disclosed herein can be modified in various ways without departing from the spirit and the scope of the present invention. Therefore, the present invention is not to be construed as being limited to the content of the embodiments included herein. Note that in the drawings in this specification, the same reference numerals are used for the same portions and portions having similar functions, and the description thereof is not repeated.

Note that the size, the thickness of a layer, or a region of each structure illustrated in drawings or the like in embodiments is exaggerated for simplicity in some cases. Therefore, embodiments of the present invention are not limited to such scales.

(Embodiment 1)

FIG. 1A is a simplified diagram of a display device in this embodiment. FIG. 1A illustrates a scan line driver circuit 101, a signal line driver circuit 102, scan lines 103, signal lines 104, power supply lines 105, and a display portion 106. Note that the scan line driver circuit 101 and the signal line driver circuit 102 may be collectively referred to as a driver circuit 107. The power supply lines 105 are extended from a power supply circuit 108 and supply a desired power supply voltage to each pixel. In the display portion 106, a plurality of pixels 109 are provided so as to be surrounded by the scan lines 103, the signal lines 104, and the power supply lines 105. Note that described is the case of 3n scan lines 103 ($G_{R1}$ to $G_{Rn}$, $G_{G1}$ to $G_{Gn}$, and $G_{B1}$ to $G_{Bn}$; n is a natural number), m signal lines 104 ($S_1$ to $S_m$, m is a natural number), and m power supply lines 105 ($V_1$ to $V_m$, m is a natural number). Therefore, (3n×m) pixels 109 and (3n+m+m) wirings are arranged in the display portion 106.

Figure 1B:
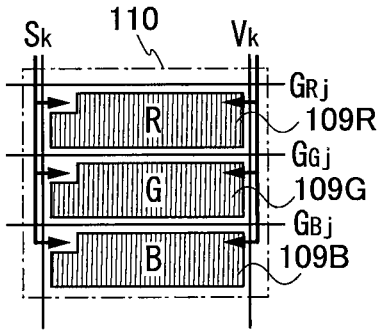

Next, FIG. 1B illustrates a picture element 110 connected to scan lines $G_{Rj}$, $G_{Gj}$, and $G_{Bj}$, a signal line $S_k$, and a power supply line $V_k$ (j and k are each a natural number of n or smaller). The picture element 110 includes a pixel 109R corresponding to R (also referred to as a first pixel), a pixel 109G corresponding to G (also referred to as a second pixel), and a pixel 109B corresponding to B (also referred to as a third pixel). Therefore, in one picture element, the signal line $S_k$ and the power supply line $V_k$ are placed in the direction perpendicular to the scan line 103 and supply predetermined voltages and gray scale signals to each pixel. Moreover, the scan lines $G_{Rj}$, $G_{Gj}$, and $G_{Bj}$ are placed in the direction perpendicular to the signal line 104 and the power supply line 105.

Note that terms such as first, second, third to Nth (N is a natural number) employed in this specification are used in order to avoid confusion between components and do not set a limitation on number.

Figure 1C:
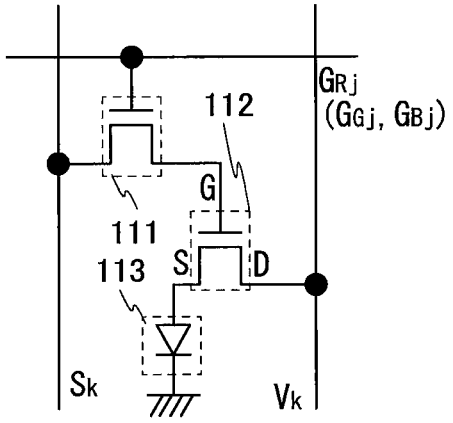

FIG. 1C illustrates a basic circuit configuration for driving a light-emitting element included in each pixel. FIG. 1C illustrates a circuit configuration of a pixel including a transistor with n-type conductivity, and is a circuit diagram of a pixel corresponding to R in FIG. 1B, for example, in which n-channel transistors are used as a selection transistor for selecting a pixel (hereinafter referred to as a first transistor 111) and a driving transistor for supplying current to a light-emitting element (hereinafter referred to as a second transistor 112). In FIGS. 1A to 1C, a first terminal of the first transistor 111 in the pixel 109R corresponding to R is connected to the signal line $S_k$, a gate thereof is connected to the scan line $G_{Rj}$, and a second terminal thereof is connected to a gate of the second transistor 112. A first terminal of the second transistor 112 is electrically connected to the power supply line $V_k$, and a second terminal thereof is connected to one electrode of a light-emitting element 113. The other electrode of the light-emitting element 113 is connected to a common electrode GND or the like. Moreover, in FIGS. 1A to 1C, a first terminal of the first transistor 111 in the pixel 109G corresponding to G is connected to the signal line $S_k$, a gate thereof is connected to the scan line $G_{Gj}$, and a second terminal thereof is connected to a gate of the second transistor 112. A first terminal of the second transistor 112 is electrically connected to the power supply line $V_k$, and a second terminal thereof is connected to one electrode of a light-emitting element 113. The other electrode of the light-emitting element 113 is connected to the common electrode GND or the like. Furthermore, in FIGS. 1A to 1C, a first terminal of the first transistor 111 in the pixel 109B corresponding to B is connected to the signal line $S_k$, a gate thereof is connected to the scan line $G_{Bj}$, and a second terminal thereof is connected to a gate of the second transistor 112. A first terminal of the second transistor 112 is electrically connected to the power supply line $V_k$, and a second terminal thereof is connected to one electrode of a light-emitting element 113. The other electrode of the light-emitting element 113 is connected to the common electrode GND or the like.

By using a multi-gate transistor including a plurality of gate terminals as the first transistor and the second transistor, the current flowing when the transistor is off can be reduced.

Note that the description "A and B are connected" denotes a state that A and B are electrically connected.

Note that a transistor is an element having at least three terminals of a gate, a drain, and a source. The transistor has a channel region between a drain region and a source region, and current can flow through the drain region, the channel region, and the source region. Here, since the source and the drain of the transistor may change depending on the structure, the operating condition, and the like of the transistor, it is difficult to define which is a source or a drain. Therefore, in this document (the specification, the claims, the drawings, and the like), a region functioning as a source or a drain is not called the source or the drain in some cases. In such a case, for example, one of the source and the drain is referred to as a first terminal, a first electrode, or a source region and the other of the source and the drain is referred to as a second terminal, a second electrode, or a drain region in some cases.

In the configuration in FIG. 1C, an n-channel transistor is used as the second transistor 112. For that reason, in order that current flows from the power supply line $V_k$ through the light-emitting element 113, the first terminal connected to the power supply line serves as a drain terminal and the second terminal connected to the light-emitting element serves as a source terminal. Thus, when power supply lines passing through one picture element are shared in common, driving voltages cannot be changed between the pixels corresponding to color elements. The unified power supply line 105 is placed on the drain terminal side. As a result, a desired gray scale can be expressed without adverse effect on the gate-source voltage (also referred to as $V_{gs}$) of the second transistor 112.

Note that n-channel transistors can be used as the first transistor 111 and the second transistor 112. In the structure described in this embodiment, it is particularly preferable to use a thin film transistor including an oxide semiconductor such as ZnO or a—InGaZnO. It is preferable to use an oxide semiconductor for a semiconductor layer of a transistor because it is possible to obtain n-channel transistors whose variations in threshold voltage are smaller than those of polycrystalline silicon or the like and whose mobility is higher than that of amorphous silicon or the like. Note that it is preferable to use an oxide semiconductor for the semiconductor layer of the transistor because the mobility of the transistor can be 5 $cm^2/Vs$ to 20 $cm^2/Vs$.

Figure 2:
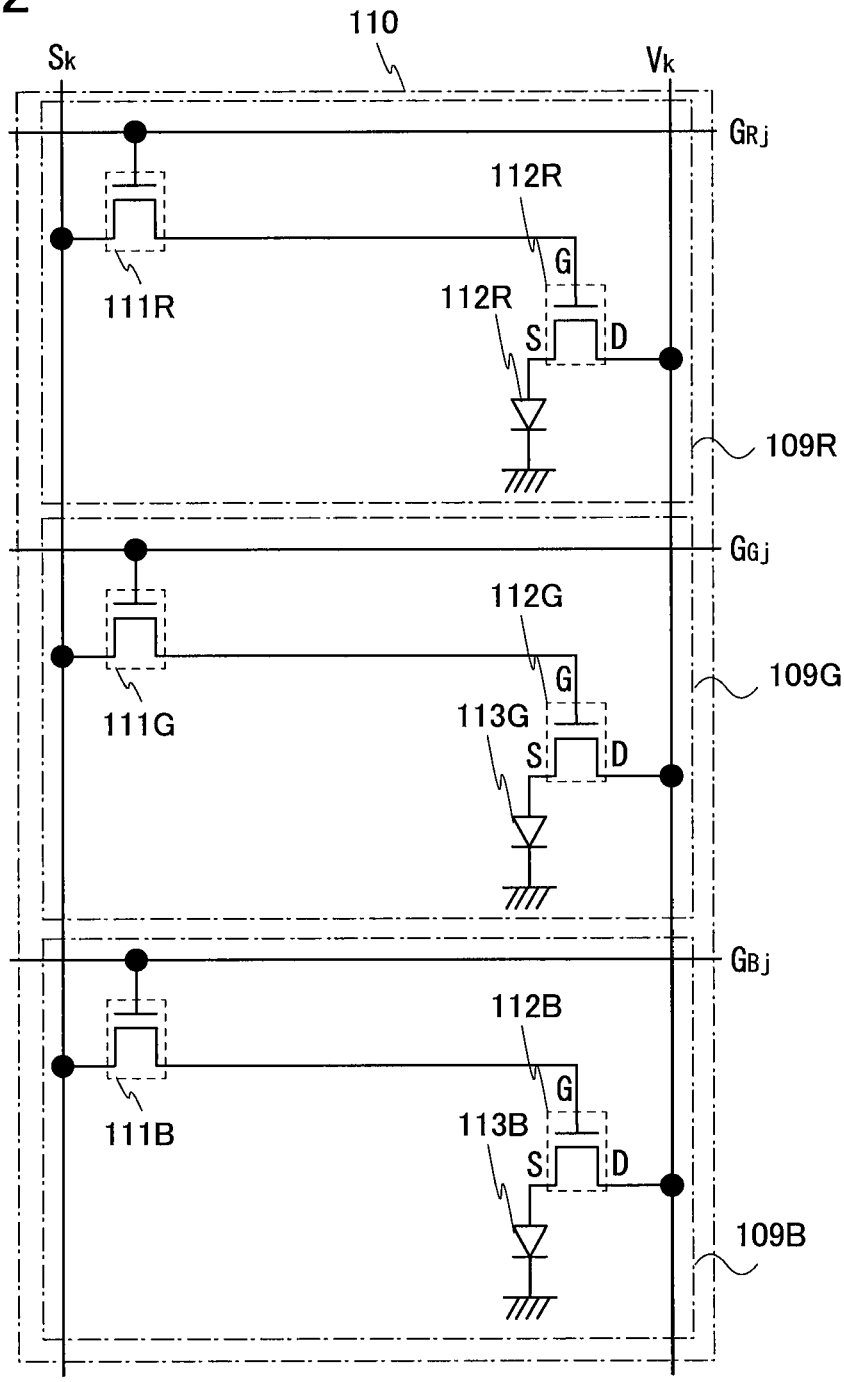
FIG. 2 illustrates a display device in Embodiment 1.

FIG. 2 illustrates the picture element 110 in FIG. 1B by using the circuit diagram illustrated in FIG. 1C. As described above, in the first pixel 109R, the second pixel 109G, and the third pixel 109B in this embodiment, signal lines and power supply lines are shared in common so that the number of wirings in parallel with the signal line can be drastically reduced. In addition, the first transistor and the second transistor are n-channel transistors. For that reason, in the case where the potentials have a relation such that current flows from the power supply line through the light-emitting element, the first terminal of the second transistor serves as a drain terminal and the second terminal thereof serves as a source terminal. Therefore, fluctuations in potential of the power supply line does not adversely affect $V_{gs}$ of second transistors 112R, 112G, and 112B, so that favorable display can be obtained. Moreover, by using an oxide semiconductor for a semiconductor layer of an n-channel transistor, variations in electric characteristics can be reduced and the display quality can be improved.

Figure 10A:
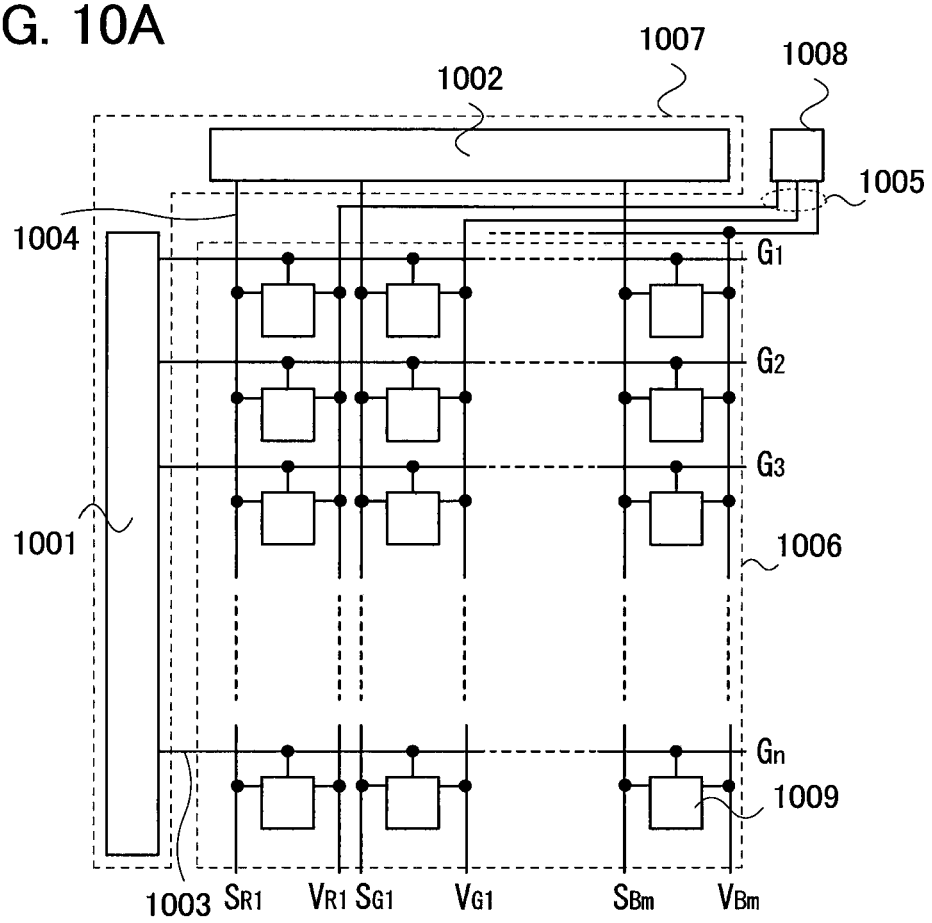
FIGS. 10A to 10C illustrate a problem of a conventional structure.
Figure 10B:
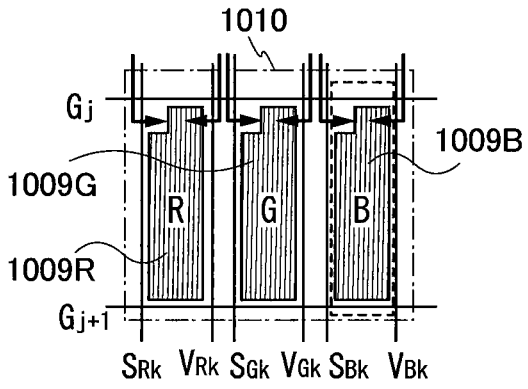
Figure 10C:
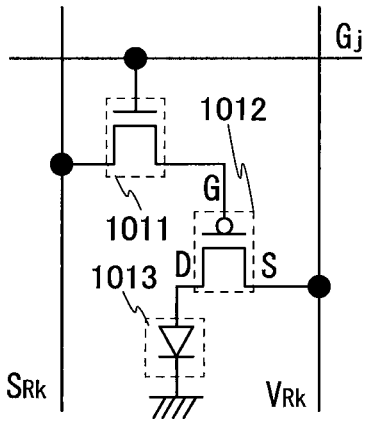

Note that as described above, the total number of power supply lines and signal lines in FIGS. 10A to 10C is (3 m+3 m+n), and the total number of power supply lines and signal lines in FIGS. 1A to 1C is (m+3n). The aspect ratio of a display portion in a display device is often m>n, which means that the width of the display device is larger than the length. Therefore, it can be found that (3 m+3 m+n) is larger than (m+3n), and that the number of wirings can be reduced in the display device in this embodiment. Moreover, with the reduction in the number of wirings in the display device in this embodiment, display with higher definition and higher quality can be performed. In particular, it is preferable to employ the structure in this embodiment because a problem that the distance between wirings is decreased with the increase in the number of wirings can be solved even when color elements included in a picture element are increased.

In FIG. 1A, the scan line driver circuit 101 supplies a scan signal to the scan line 103. The signal line driver circuit 102 supplies image data (hereinafter simply referred to as data)

to the signal line 104. With scan signals from the scan lines 103, the pixels 109 are sequentially selected from the scan line 103 of the first row.

Note that the structure where the first pixel, the second pixel, and the third pixel correspond to the respective color elements of R (red), G (green), and B (blue) is described; alternatively, any combination that can express a desired color by controlling the brightness in combination can be employed. For example, a combination of Y (yellow), C (cyan), and M (magenta) may be used.

Note that in this specification, one pixel represents one color element and expresses brightness of one color element. For example, in a color display device including color elements of R, G, and B, a minimum unit of an image is composed of three pixels of an R pixel, a G pixel, and a B pixel. Moreover, a color display device may include a white (W) color element in addition to RGB.

Figure 3A:
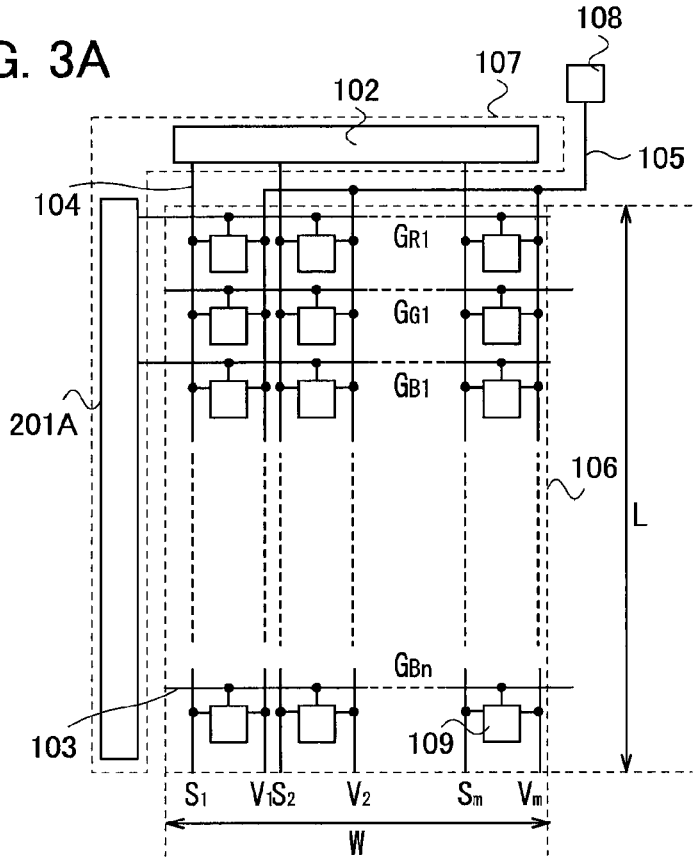
FIGS. 3A and 3B each illustrate a display device in Embodiment 1.

Instead of the configuration illustrated in FIG. 1A, as illustrated in FIG. 3A, a scan line driver circuit 201A may be placed in a longer side portion of the display portion 106 (a region on the longer side represented by L in FIG. 3A) and the signal line driver circuit 102 may be placed in a shorter side portion of the display portion 106 (a region on the shorter side represented by W in FIG. 3A). With the structure in this embodiment, display can be performed without a decrease in display quality of the display portion even when the number of signal lines 104 and power supply lines 105 is reduced and the number of scan lines 103 is increased.

Figure 3B:
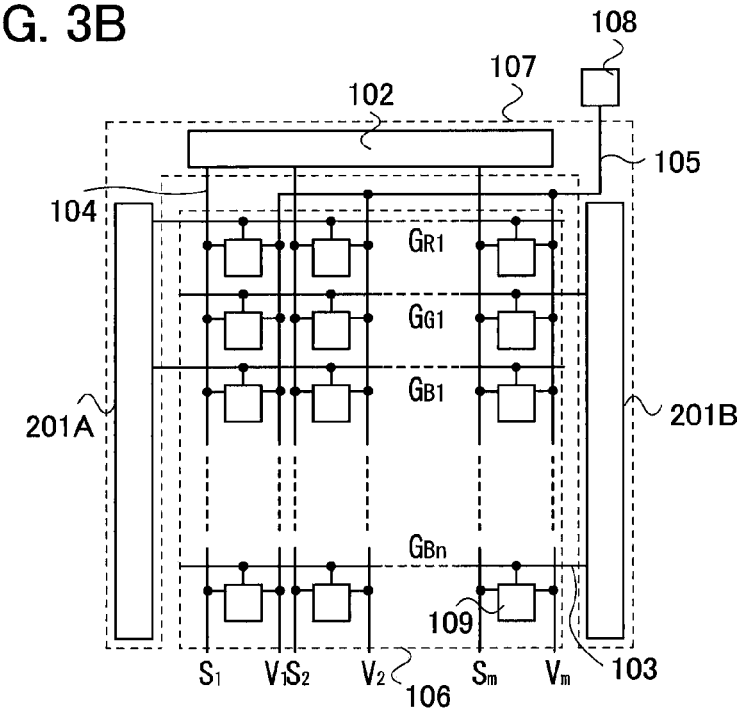

As illustrated in FIG. 3B, a plurality of scan line driver circuits may be provided. FIG. 3B illustrates a structure in which the first scan line driver circuit 201A and a second scan line driver circuit 201B are provided as a plurality of scan line driver circuits. Note that the first scan line driver circuit 201A and the second scan line driver circuit 201B may be separately driven so that one of the circuits drives odd-numbered scan lines 103 and the other drives even-numbered scan lines 103, or may be alternately driven every given period. In the structure in this embodiment, the number of scan lines 103 is increased in accordance with the number of color elements used in combination. For example, when the first scan line driver circuit 201A and the second scan line driver circuit 201B are placed on the opposite sides of the display device, the scan line driver circuit can be driven at lower operation speed and power consumption can be reduced by a reduction in frequency of a clock signal input to the scan line driver circuit. Furthermore, it is preferable to arrange the scan line driver circuits on the right and left of the display portion because the scan line driver circuits can have redundancy.

Next, a method for driving a picture element including the above-described first to third pixels will be described.

Figure 4:
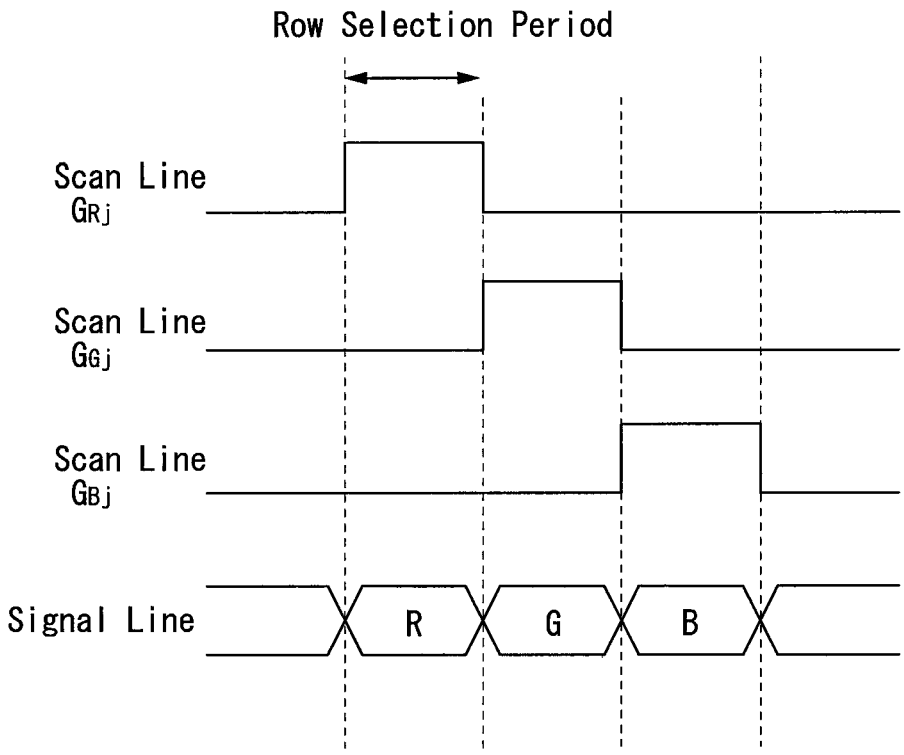
FIG. 4 illustrates a display device in Embodiment 1.

A timing chart in FIG. 4 illustrates a scan signal of the scan line $G_{Rj}$, a scan signal of the scan line $G_{Gj}$, a scan signal of the scan line $G_{Bj}$, and image data of the signal line in a row selection period (a time for scanning pixels of one row in the display device).

Note that the transistors in the pixels shown in this embodiment are n-channel transistors. For that reason, a pixel connected to a scan line is selected with an H signal (a high potential signal), and a potential of a signal line is input to each pixel. In contrast, a pixel connected to a scan line is not selected with an L signal (a low potential signal).

In the method for driving pixels of this embodiment illustrated in the timing chart in FIG. 4, first, the scan signal of the scan line $G_{Rj}$ is set to a high potential signal, so that the first transistor in the first pixel enters into the on state. At this time, the potential of the signal line is supplied to the gate of the second transistor in the first pixel. Then, the second pixel and the third pixel are selected with selection signals of the scan lines $G_{Gj}$, and $G_{Bj}$, and the potential of the signal line is input to the second pixel and the third pixel.

Note that "the on state" of a transistor in this specification represents the state where a first terminal and a second terminal of the transistor are brought into conduction.

Figure 5:
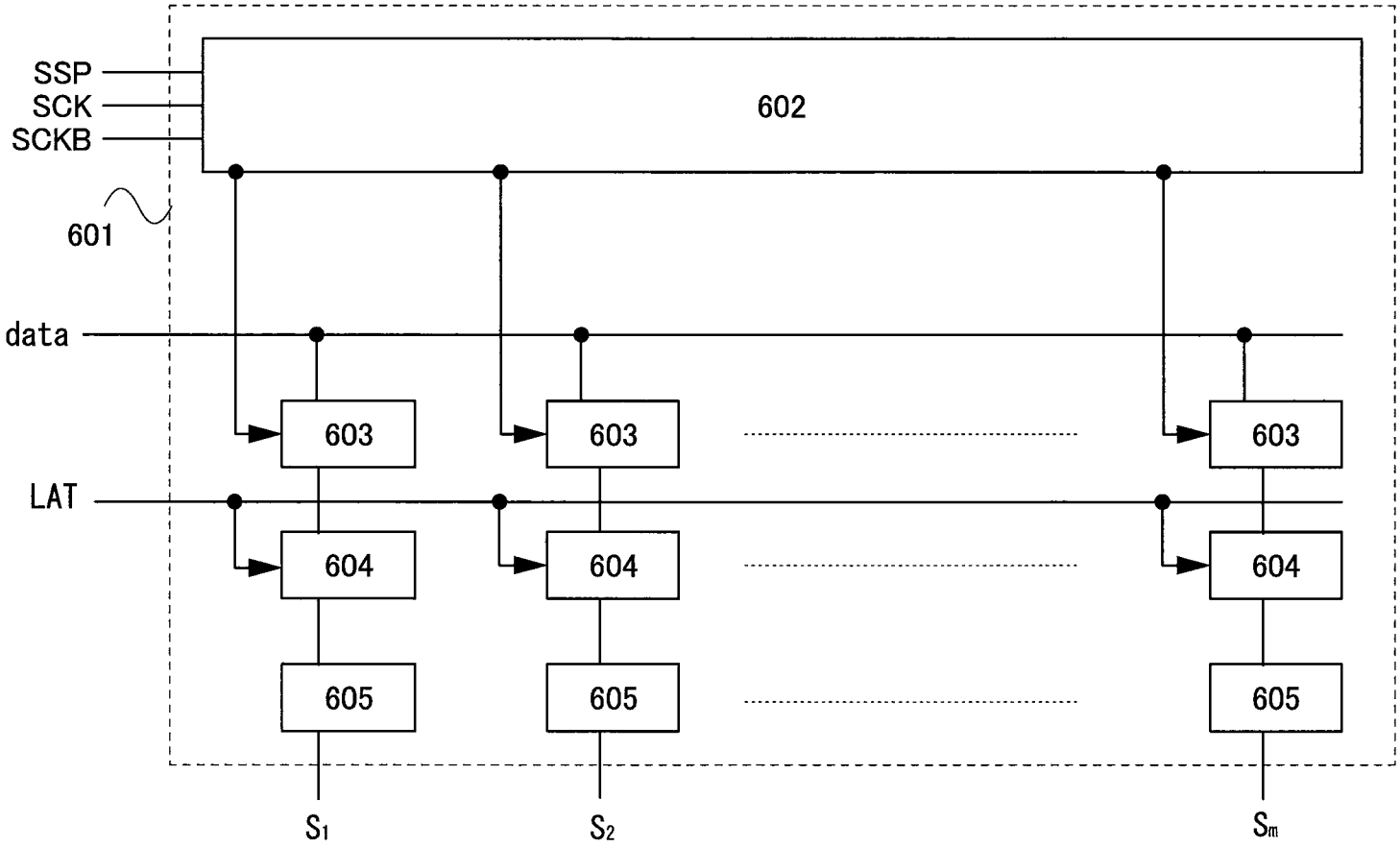
FIG. 5 illustrates a display device in Embodiment 1.

Next, advantages of the display device in this embodiment will be described, showing the structures of a signal line driver circuit (also referred to as a source driver) and a scan line driver circuit (also referred to as a gate driver). FIG. 5 is a block diagram of the signal line driver circuit.

A signal line driver circuit 601 in FIG. 5 includes a shift register 602, first latch circuits 603, second latch circuits 604, and D/A conversion circuits 605.

A source driver start pulse (SSP), a source driver clock signal (SCK), an inverted source driver clock signal (SCKB), and the like are supplied to the shift register 602. The shift register 602 selects the first latch circuits 603 one by one. Note that a level shifter circuit may be provided between the shift register 602 and the first latch circuit 603.

An input terminal of the first latch circuit 603 is connected to an output terminal of the shift register 602 and a wiring from which image data (data) is input. An output terminal of the first latch circuit 603 is connected to the second latch circuit 604.

The second latch circuit 604 stores image data that has been input to the first latch circuit 603, and is connected to a wiring from which a signal (Lat) for controlling the second latch circuit 604 is input. An output terminal of the second latch circuit 604 is connected to the D/A conversion circuit 605.

The D/A conversion circuit 605 converts digital image data that are output simultaneously in accordance with the signals for controlling the second latch circuits 604, into analog data. Output terminals of the D/A conversion circuits 605 are connected to the respective signal lines $S_1$ to $S_m$.

With the structure in this embodiment, the number of signal lines connected to pixels as well as the number of power supply lines can be reduced. Therefore, in the structure of the signal line driver circuit illustrated in FIG. 5, the number of output wirings from the shift register 602 can be reduced, and the number of the first latch circuits 603, the second latch circuits 604, and the D/A conversion circuits 605 can be reduced. Specifically, in the display device in this embodiment, the number of the signal lines can be reduced to one-third, whereby costs for the shift register 602, the first latch circuits 603, the second latch circuits 604, and the D/A conversion circuits 605 can be reduced. In particular, the D/A conversion circuits 605 consume such a large amount of power that heat generation becomes a problem, because voltages output to pixels need to be raised. With the structure in this embodiment, however, the number of the D/A conversion circuits 605 can be reduced, whereby power consumption can be reduced.

Figure 6:
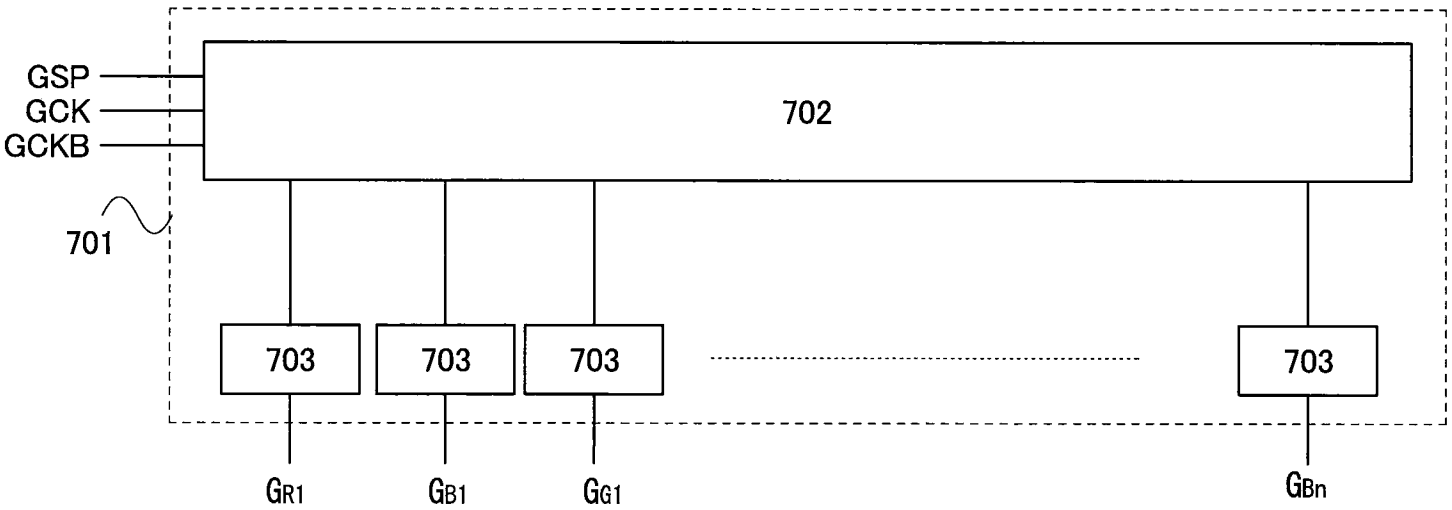
FIG. 6 illustrates a display device in Embodiment 1.

FIG. 6 is a block diagram of the scan line driver circuit.

A scan line driver circuit 701 in FIG. 6 includes a shift register 702 and buffer circuits 703.

A gate driver start pulse (GSP), a gate driver clock signal (GCK), an inverted gate driver clock signal (GCKB), and the like are supplied to the shift register 702. The shift register 702 selects the buffer circuits 703 one by one. Note that a level shifter circuit may be provided between the shift register 702 and the buffer circuit 703. When power consumed by the scan line driver circuit 701 is large, a level shifter circuit may adjust the voltage level so that the voltage can drive a scan line. Moreover, the shift register 702 may be operated while the frequency and amplitude voltage of a clock signal are reduced when needed. By the use of an oxide semiconductor for a semiconductor layer of a transistor included in the shift register 702, reduction in threshold voltage can be expected; thus, lowering the voltage of the clock signal is particularly effective in reducing power consumption.

The buffer circuit is a circuit for enhancing the current supply capability of a signal supplied to a scan line and may have a structure in which a plurality of stages of inverter circuits or the like are provided in series.

With the structure in this embodiment, the number of signal lines connected to pixels can be reduced. That is, in the display device in this embodiment, the number of the signal lines can be reduced to one-third, whereby costs for the circuits included in the signal line driver circuit 601 can be reduced. Power consumption can be reduced particularly by the reduction in the number of D/A conversion circuits. Furthermore, the reduction in the number of power supply lines and signal lines can reduce malfunctions such as crosstalk due to the overcrowded state of wirings, add color elements, and increase the number of pixels in a display portion. Thus, the display device can display high definition images with high quality.

This embodiment can be implemented in combination with any of the other embodiments as appropriate.

(Embodiment 2)

In this embodiment, a structure of a pixel in the display device described in Embodiment 1 will be described with reference to a top view, and a circuit diagram and a cross-sectional view corresponding to the top view.

Figure 7A:
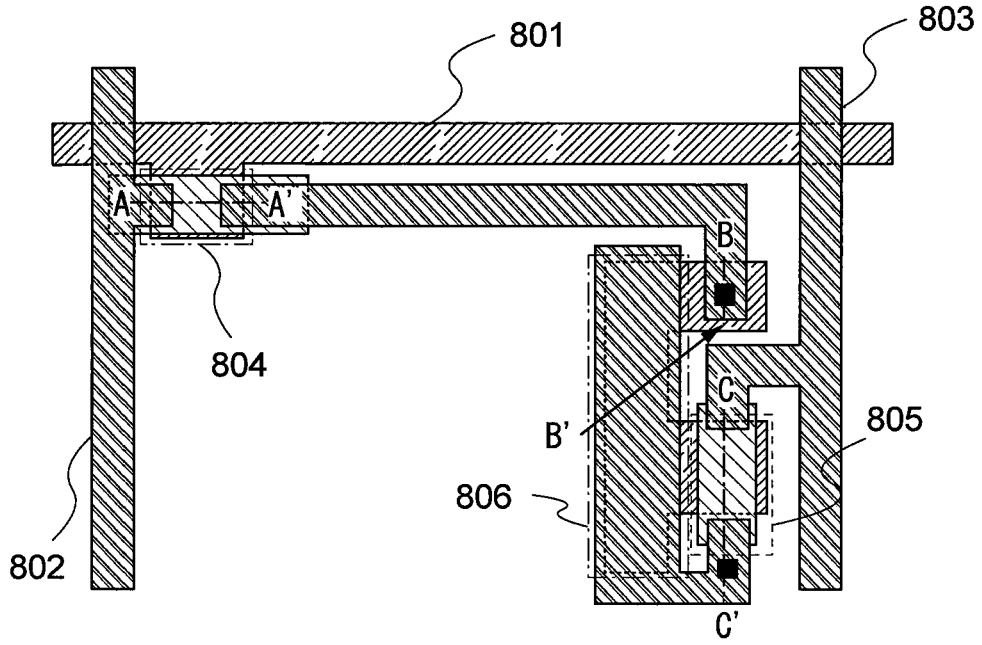
FIGS. 7A and 7B illustrate a display device in Embodiment 2.
Figure 7B:
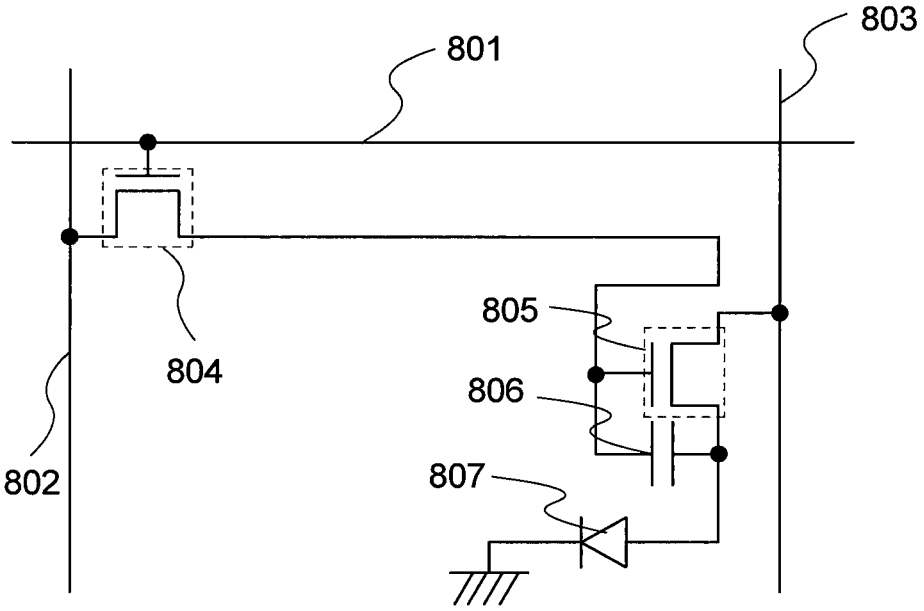
Figure 8:
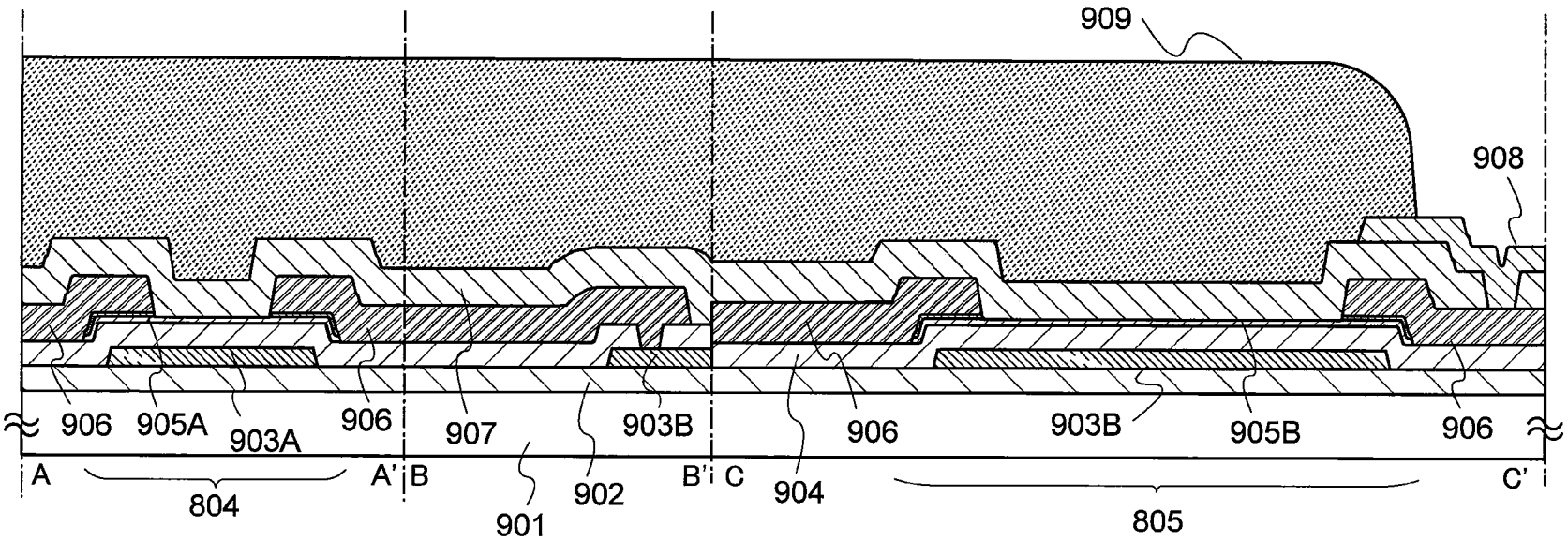
FIG. 8 illustrates a display device in Embodiment 2.

FIGS. 7A and 7B and FIG. 8 illustrate a cross-sectional view of a pixel in which thin film transistors (TFTs) are used as the first transistor and the second transistor described in Embodiment 1, and a corresponding circuit diagram and top view. FIG. 7A is a top view of the pixel, and FIG. 7B is a circuit diagram of the pixel corresponding to FIG. 7A. The cross-sectional view of the pixel illustrated in FIG. 8 corresponds to lines A-A', B-B', and C-C' in the top view of the pixel illustrated in FIG. 7A.

First, an example of a layout of the pixel in the display device will be described with reference to FIGS. 7A and 7B. Note that FIGS. 7A and 7B illustrate a structure used for the first to third pixels described in Embodiment 1.

The pixel that is illustrated in FIG. 7A and can be applied to the display device in Embodiment 1 includes, for example, a scan line 801, a signal line 802, a power supply line 803, a first transistor 804, a second transistor 805, and a capacitor 806 for holding $V_{gs}$ of the second transistor 805. Note that the capacitor 806 is not necessarily provided. FIG. 7B illustrates the circuit diagram corresponding to FIG. 7A. A light-emitting element 807 that is illustrated in FIG. 7B and connected to the second transistor 805 is not shown in FIG. 7A. The light-emitting element 807 may be formed in such a manner that a light-emitting layer and a cathode included in the light-emitting element are stacked in this order over a pixel electrode serving as an anode.

The scan line 801 is preferably provided in a layer that is different from the layer in which in the signal line 802 and the power supply line 803 are provided, in the direction perpendicular to the signal line 802 and the power supply line 803. The signal line 802 is electrically connected to the first transistor 804. Here, it is preferable that the signal line 802 be electrically connected to the first transistor 804 directly, not through a contact hole. Similarly, it is preferable that a second terminal of the first transistor 804 and a gate of the second transistor 805 be connected to each other without using another wiring, with a structure in which the wiring in the same layer as the signal line 802 and the wiring in the same layer as the scan line 801 are directly connected through a contact hole.

The power supply line 803 is preferably provided in the same layer as the signal line 802 and in parallel to the signal line 802. Moreover, the power supply line 803 is preferably connected to a first terminal of the first transistor 804 directly, not through a contact hole. Note that electrodes included in the capacitor 806 are preferably formed using a wiring connected to the gate of the second transistor 805 which is in the same layer as the scan line 801 and a wiring that is directly connected to a second terminal of the second transistor 805, because leading of an extra wiring or the like can be reduced. The wiring that is directly connected to the second terminal of the second transistor 805 is electrically connected to a wiring that is led to an upper layer, through an opening portion; thus, a light-emitting element can be formed.

Next, the structure in the cross-sectional view illustrated in FIG. 8 is described. In this embodiment, a method for forming a thin film transistor particularly when a semiconductor layer is formed using an oxide semiconductor is described.

First, a base film 902 is deposited over a substrate 901. Next, a conductive film is formed over the base film 902, and then, gate electrode layers 903A and 903B are formed in a photolithography step.

Note that a resist mask may be formed by an ink-jet method. A photomask is not used when the resist mask is formed by an ink-jet method, which results in reducing manufacturing costs.

For the conductive film for forming the gate electrode layers 903A and 903B, an element selected from Al, Cr, Ta, Ti, Mo, or W, an alloy containing any of the above elements, an alloy containing any of these elements in combination, and the like can be used.

In the case where a glass substrate is used as the substrate 901 and the temperature of heat treatment to be performed later is high, it is preferable to use a glass substrate whose strain point is greater than or equal to 730° C. For example, a glass material such as aluminosilicate glass, aluminoborosilicate glass, or barium borosilicate glass is used for a glass substrate.

The base film 902 has a function of preventing diffusion of an impurity element from the substrate 901 and can be formed with a single-layer structure or a layered structure using a silicon nitride film, a silicon oxide film, a silicon nitride oxide film, and/or a silicon oxynitride film.

Then, a gate insulating layer 904 is formed over the gate electrode layers 903A and 903B.

The gate insulating layer 904 can be formed with a single-layer structure or a layered structure using a silicon oxide layer, a silicon nitride layer, a silicon oxynitride layer, and/or a silicon nitride oxide layer by a plasma CVD method, a sputtering method, or the like. For example, a silicon oxynitride layer may be formed by a plasma CVD method using $SiH_4$, oxygen, and nitrogen as a deposition gas.

Next, the gate insulating layer 904 is selectively etched by a photolithography step, so that a contact hole reaching the gate electrode layer 903B is formed.

Then, an oxide semiconductor film is formed over the gate insulating layer 904. The thickness of the oxide semiconductor film is preferably as thin as 50 nm or less in the case where the oxide semiconductor film keeps the amorphous state even when heat treatment for dehydration or dehydrogenation is performed after the formation of the oxide semiconductor film.

As the oxide semiconductor film, any of the following is used: an In—Ga—Zn—O-based oxide semiconductor film, an In—Sn—Zn—O-based oxide semiconductor film, an In—Al—Zn—O-based oxide semiconductor film, a Sn—Ga—Zn—O-based oxide semiconductor film, an Al—Ga—Zn—O-based oxide semiconductor film, a Sn—Al—Zn—O-based oxide semiconductor film, an In—Zn—O-based oxide semiconductor film, a Sn—Zn—O-based oxide semiconductor film, an Al—Zn—O-based oxide semiconductor film, an In—O-based oxide semiconductor film, a Sn—O-based oxide semiconductor film, and a Zn—O-based oxide semiconductor film. The oxide semiconductor film can be formed by a sputtering method in a rare gas (typically argon) atmosphere, an oxygen atmosphere, or a mixed atmosphere of a rare gas (typically argon) and oxygen.

In this embodiment, film deposition is performed using an oxide semiconductor deposition target including In, Ga, and Zn ($In_2O_3$:$Ga_2O_3$:ZnO=1:1:1 [mol %], In:Ga:Zn=1:1:0.5 [at %]) under the following conditions: the distance between the substrate and the target is 100 mm, the pressure is 0.6 Pa, the direct current (DC) power supply is 0.5 kW, and the atmosphere is oxygen (the flow rate of oxygen is 100%). Note that a pulsed direct current (DC) power supply is preferably used because powder substances (also referred to as particles or dust) generated in film deposition can be reduced and the film thickness can be uniform.

Examples of a sputtering method are an RF sputtering method in which a high-frequency power source is used as a sputtering power source, a DC sputtering method in which a DC power supply is used, and a pulsed DC sputtering method in which a bias is applied in a pulsed manner. An RF sputtering method is mainly used for forming an insulating film, and a DC sputtering method is mainly used for forming a metal conductive film.

In addition, there is also a multi-source sputtering apparatus in which a plurality of targets of different materials can be set. With the multi-source sputtering apparatus, films of different materials can be stacked in the same chamber, or a film of plural kinds of materials can be formed by electric discharge at the same time in the same chamber.

Further, there are a sputtering apparatus that is provided with a magnet system inside the chamber and employs a magnetron sputtering, and a sputtering apparatus employing an ECR sputtering in which plasma generated with the use of microwaves is used without using glow discharge.

Furthermore, examples of a deposition method by sputtering are a reactive sputtering method in which a target substance and a sputtering gas component chemically react with each other during deposition to form a thin compound film thereof, and a bias sputtering in which voltage is also applied to a substrate during deposition.

Note that before the oxide semiconductor film is formed by a sputtering method, dust on a surface of the gate insulating layer 904 is preferably removed by reverse sputtering in which an argon gas is introduced and plasma is generated. The reverse sputtering refers to a method in which, without application of voltage to a target side, an RF power source is used for application of voltage to a substrate side in an argon atmosphere so that plasma is generated in the vicinity of the substrate to modify a surface. Note that instead of an argon atmosphere, a nitrogen atmosphere, a helium atmosphere, an oxygen atmosphere, or the like may be used.

Next, the oxide semiconductor film is processed into island-shaped oxide semiconductor layers 905A and 905B in a photolithography step. A resist mask for forming the island-shaped oxide semiconductor layers 905A and 905B may be formed by an ink-jet method.

Next, the oxide semiconductor layers are subjected to dehydration or dehydrogenation. The temperature of the heat treatment for dehydration or dehydrogenation is higher than or equal to 400° C. and lower than or equal to 750° C., preferably higher than or equal to 425° C. and lower than or equal to the strain point of the substrate. Note that the heat treatment may be performed for one hour or shorter when the temperature of the heat treatment is higher than or equal to 425° C.; the heat treatment is preferably performed for longer than one hour when the temperature is lower than 425° C. Here, the substrate is introduced into an electric furnace, which is one of heat treatment apparatuses, and heat treatment is performed on the oxide semiconductor layers in a nitrogen atmosphere. Then, the oxide semiconductor layers are not exposed to air, which prevents water or hydrogen from entering the oxide semiconductor layers, so that the oxide semiconductor layers are obtained. In this embodiment, slow cooling is performed in one furnace in a nitrogen atmosphere from the heating temperature T at which dehydration or dehydrogenation is performed on the oxide semiconductor layers to a temperature low enough to prevent entry of water; specifically, the slow cooling is performed until the temperature drops by 100° C. or more from the heating temperature T. Without being limited to a nitrogen atmosphere, dehydration or dehydrogenation may be performed in a rare gas atmosphere such as helium, neon, or argon. Note that the degree of crystallization of the oxide semiconductor is 90% or higher, or 80% or higher in some cases depending on the heat conditions.

Note that the heat treatment apparatus is not limited to an electronic furnace, and may be provided with a device that heats an object by heat conduction or heat radiation from a heating element such as a resistance heating element. For example, a rapid thermal annealing (RTA) apparatus such as a gas rapid thermal annealing (GRTA) apparatus or a lamp rapid thermal annealing (LRTA) apparatus can be used. An LRTA apparatus is an apparatus for heating an object by radiation of light (an electromagnetic wave) emitted from a lamp such as a halogen lamp, a metal halide lamp, a xenon arc lamp, a carbon arc lamp, a high pressure sodium lamp, or a high pressure mercury lamp. A GRTA apparatus is an apparatus for performing heat treatment using a high-temperature gas. As the gas, an inert gas that does not react with an object by heat treatment, for example, nitrogen or a rare gas such as argon is used.

Then, a conductive film is formed over the gate insulating layer 904 and the oxide semiconductor layers 905A and 905B, and after that, in a photolithography step, a resist mask is formed and etching is selectively performed so that electrode layers 906 are formed. For the conductive film, an element selected from Ti, Mo, W, Al, Cr, Cu, and Ta, an alloy containing any of these elements as a component, an alloy containing these elements in combination, or the like is used. The conductive film is not limited to a single layer containing any of the above elements and may be a stack of two or more layers. Note that only part of the conductive film that is on and in contact with the oxide semiconductor layer is selectively removed in FIG. 8. Thus, when an ammonia peroxide mixture (hydrogen peroxide:ammonia:water=5:2:2) or the like is used as an alkaline etchant in order to selectively remove only part of the conductive film, which is on and in contact with the oxide semiconductor layer, the metal conductive film can be selectively removed and the oxide semiconductor layer formed using an In—Ga—Zn—O-based oxide semiconductor can be left.

Next, an insulating layer 907 is formed over the gate insulating layer 904, the oxide semiconductor layers 905A and 905B, and the electrode layers 906. The insulating layer 907 has a thickness of at least 1 nm and can be formed by a method with which impurities such as water and hydrogen are not mixed into the insulating layer, such as a sputtering method, as appropriate. The insulating layer 907 which is formed in contact with the oxide semiconductor layers 905A and 905B is formed using an inorganic insulating film that does not contain impurities such as moisture, a hydrogen ion, and $OH^-$ and blocks entry of these impurities from the outside, typically a silicon oxide film, a silicon nitride oxide film, an aluminum oxide film, or an aluminum oxynitride film.

Next, the insulating layer 907 is selectively etched by a photolithography step, so that a contact hole reaching the electrode layer 906 is formed. Then, an electrode 908 serving as an anode of the light-emitting element is formed over the insulating layer 907. Note that a surrounding portion of the electrode 908 is covered with a partition 909. A light-emitting layer and an electrode serving as a cathode of the light-emitting element are stacked over the electrode 908 and the partition 909, and in addition, a hole-injection layer, a hole-transport layer, an electron-transport layer, and/or an electron-injection layer may be stacked. The anode is formed using a material with a high work function, and the cathode is formed using a material with a low work function. The partition 909 is formed using an organic resin film of polyimide, acrylic, polyamide, epoxy, or the like, an inorganic insulating film, or organic polysiloxane.

Through the above-described process, the first transistor 804 and the second transistor 805 can be manufactured over one substrate.

Note that the first transistor 804 and the second transistor 805 illustrated in FIG. 8 are each a bottom-gate TFT in which an oxide semiconductor is used for a semiconductor layer. However, this embodiment is not limited to a bottom-gate TFT and a top-gate TFT may be employed.

According to one embodiment of the present invention, the number of signal lines and power supply lines that are connected to pixels can be reduced. Thus, it is possible to provide a display device that can perform high definition display.

This embodiment can be implemented in combination with any of the other embodiments as appropriate.

(Embodiment 3)

In this embodiment, examples of an electronic device in which the display device in any of Embodiments 1 and 2 is included in a display portion will be described.

The content (or part of the content) described in each drawing in Embodiments 1 and 2 can be applied to a variety of electronic devices, specifically to a display portion of an electronic device. Examples of such an electronic device are a video camera, a digital camera, a goggle-type display, a navigation system, an audio reproducing device (e.g., a car audio component and an audio component), a computer, a game machine, a portable information terminal (e.g., a mobile computer, a mobile phone, a mobile game machine, and an e-book reader), and an image reproducing device provided with a recording medium (specifically, a device that reproduces contents of a recording medium such as a digital versatile disc (DVD) and has a display for displaying the reproduced image).

Figure 9A:
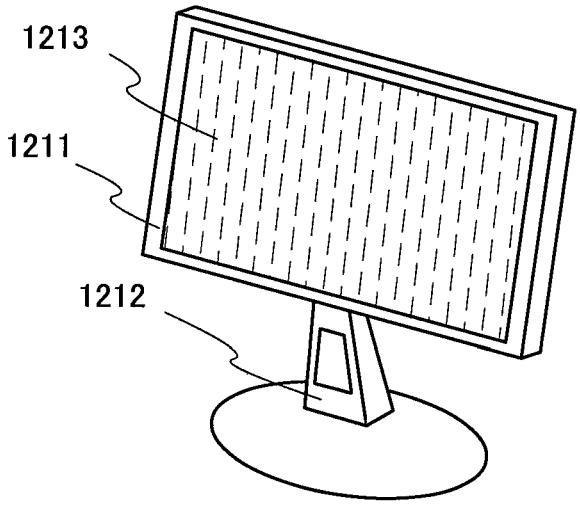
FIGS. 9A to 9C each illustrate an electronic device in Embodiment 3.

FIG. 9A illustrates a display that include a housing 1211, a support base 1212, and a display portion 1213. The display illustrated in FIG. 9A has a function of displaying a variety of information (e.g., still images, moving images, and text images) on the display portion. Note that the display in FIG. 9A is not limited to having this function and can have a variety of functions.

Figure 9B:
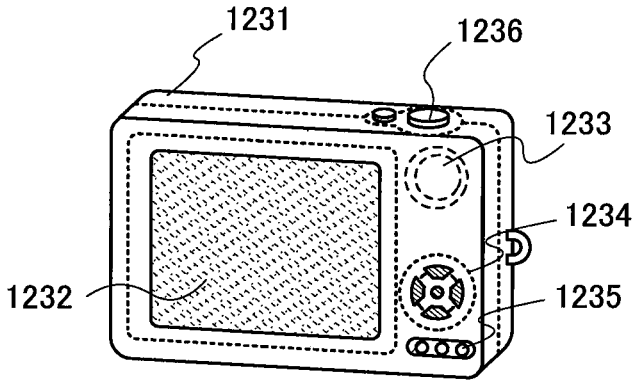

FIG. 9B illustrates a camera that includes a main body 1231, a display portion 1232, an image receiving portion 1233, operation keys 1234, an external connection port 1235, and a shutter button 1236. The camera illustrated in FIG. 9B has a function of taking still images and a function of taking moving images. Note that the functions of the camera in FIG. 9B are not limited to these functions, and the camera can have a variety of functions.

Figure 9C:
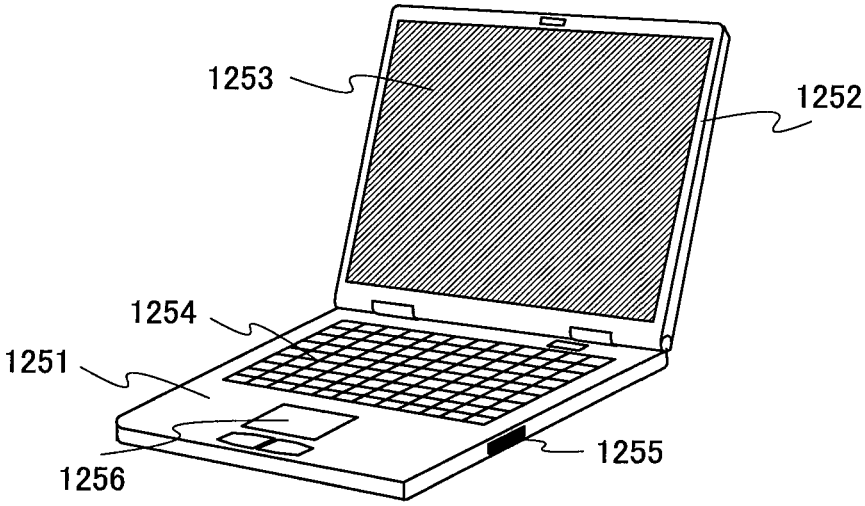

FIG. 9C illustrates a computer that includes a main body 1251, a housing 1252, a display portion 1253, a keyboard 1254, an external connection port 1255, and a pointing device 1256. The computer illustrated in FIG. 9C has a function of displaying a variety of information (e.g., still images, moving images, and text images) on the display portion. Note that the computer in FIG. 9C is not limited to having this function and can have a variety of functions.

The display device described in any of Embodiments 1 and 2 is used in the display portion in this embodiment, whereby the number of signal lines and power supply lines that are connected to pixels included in the display portions illustrated in FIGS. 9A to 9C can be reduced. Moreover, the number of elements in a signal line driver circuit connected to the signal lines can be reduced, so that costs can be reduced and high definition display can be performed on the display portion.

This embodiment can be implemented in combination with any of the other embodiments as appropriate.

This application is based on Japanese Patent Application serial no. 2009-205132 filed with Japan Patent Office on Sep. 4, 2009, the entire contents of which are hereby incorporated by reference.

What is claimed is:

1. A display device comprising:

a signal line;

a power supply line;

a first scan line;

a first transistor, wherein a gate of the first transistor is electrically connected to the first scan line and wherein one of a source and a drain of the first transistor is electrically connected to the signal line so that a signal is supplied to the one of the source and the drain of the first transistor;

a second transistor, wherein a gate of the second transistor is electrically connected to the other of the source and the drain of the first transistor and wherein one of a source and a drain of the second transistor is electrically connected to the power supply line so that a voltage is supplied to the one of the source and the drain of the second transistor;

a first light-emitting element electrically connected to the other of the source and the drain of the second transistor;

a second scan line;

a third transistor, wherein a gate of the third transistor is electrically connected to the second scan line and wherein one of a source and a drain of the third transistor is electrically connected to the signal line so that the signal is supplied to the one of the source and the drain of the third transistor;

a fourth transistor, wherein a gate of the fourth transistor is electrically connected to the other of the source and the drain of the third transistor and wherein one of a source and a drain of the fourth transistor is electrically connected to the power supply line so that the voltage is supplied to the one of the source and the drain of the fourth transistor; and a second light-emitting element electrically connected to the other of the source and the drain of the fourth transistor, wherein the first light-emitting element is configured to emit a first light, wherein the second light-emitting element is configured to emit a second light, and wherein a first color of the first light is different from a second color of the second light, wherein each of the first transistor, the second transistor, the third transistor and the fourth transistor comprises an oxide semiconductor layer, the oxide semiconductor layer comprising a channel region, and wherein the oxide semiconductor layer is heated under an atmosphere comprising nitrogen at a heating temperature and cooled until a temperature drops by 100° C. or more from the heating temperature without exposing to air.

2. The display device according to claim 1, wherein each of the first transistor, the second transistor, the third transistor and the fourth transistor is an n-channel transistor.

3. The display device according to claim 1, wherein each of the first light-emitting element and the second light-emitting element is an organic EL element.

4. An electronic device comprising the display device according to claim 1.

5. A display device comprising:

a signal line;

a power supply line;

a first scan line;

a first transistor, wherein a gate of the first transistor is electrically connected to the first scan line and wherein one of a source and a drain of the first transistor is electrically connected to the signal line so that a signal is supplied to the one of the source and the drain of the first transistor;

a second transistor, wherein a gate of the second transistor is electrically connected to the other of the source and the drain of the first transistor and wherein one of a source and a drain of the second transistor is electrically connected to the power supply line so that a voltage is supplied to the one of the source and the drain of the second transistor;

a first light-emitting element configured to emit a red light, the first light-emitting element being electrically connected to the other of the source and the drain of the second transistor;

a second scan line;

a third transistor, wherein a gate of the third transistor is electrically connected to the second scan line and wherein one of a source and a drain of the third transistor is electrically connected to the signal line so that the signal is supplied to the one of the source and the drain of the third transistor;

a fourth transistor, wherein a gate of the fourth transistor is electrically connected to the other of the source and the drain of the third transistor and wherein one of a source and a drain of the fourth transistor is electrically connected to the power supply line so that the voltage is supplied to the one of the source and the drain of the fourth transistor;

a second light-emitting element configured to emit a green light, the second light-emitting element being electrically connected to the other of the source and the drain of the fourth transistor;

a third scan line;

a fifth transistor, wherein a gate of the fifth transistor is electrically connected to the third scan line and wherein one of a source and a drain of the fifth transistor is electrically connected to the signal line so that the signal is supplied to the one of the source and the drain of the fifth transistor;

a sixth transistor, wherein a gate of the sixth transistor is electrically connected to the other of the source and the drain of the fifth transistor and wherein one of a source and a drain of the sixth transistor is electrically connected to the power supply line so that the voltage is supplied to the one of the source and the drain of the sixth transistor; and a third light-emitting element configured to emit a blue light, the third light-emitting element being electrically connected to the other of the source and the drain of the sixth transistor, wherein each of the first transistor, the second transistor, the third transistor, the fourth transistor, the fifth transistor, and the sixth transistor comprises an oxide semiconductor layer, the oxide semiconductor layer comprising a channel region, and wherein the oxide semiconductor layer is heated under an atmosphere comprising nitrogen at a heating temperature and cooled until a temperature drops by 100° C. or more from the heating temperature without exposing to air.

6. The display device according to claim 5, wherein each of the first transistor, the second transistor, the third transistor, the fourth transistor, the fifth transistor and the sixth transistor is an n-channel transistor.

7. The display device according to claim 5, wherein each of the first light-emitting element, the second light-emitting element and the third light-emitting element is an organic EL element.

8. An electronic device comprising the display device according to claim 5.

* * * * *